US008499975B2

(12) United States Patent
Bortoletto et al.

(10) Patent No.: US 8,499,975 B2
(45) Date of Patent: Aug. 6, 2013

(54) REFRIGERATOR BEVERAGE FLAVOR DISPENSER WITH FLAVOR STRENGTH ADJUSTMENT

(75) Inventors: Anderson Bortoletto, Waunakee, WI (US); John R. Wisnoski, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 270 days.

(21) Appl. No.: 12/915,437

(22) Filed: Oct. 29, 2010

(65) Prior Publication Data

US 2012/0104028 A1 May 3, 2012

(51) Int. Cl.
*B67D 7/00* (2010.01)

(52) U.S. Cl.
USPC ..... 222/129.3; 222/1; 222/132; 222/144.5

(58) Field of Classification Search
USPC ..... 222/129.3, 282, 1, 132, 144.5, 146.6; 62/389
See application file for complete search history.

(56) References Cited

U.S. PATENT DOCUMENTS 6,382,467 B2 * 5/2002 Saveliev et al. ..... 222/148
6,612,224 B2 9/2003 Mercier et al.
7,032,779 B2 * 4/2006 Crisp et al. ..... 222/129.1
7,455,867 B1 11/2008 Gutwein et al.
7,708,172 B2 * 5/2010 Crisp et al. ..... 222/399
8,083,104 B2 * 12/2011 Roetker et al. ..... 222/146.1
8,215,228 B2 * 7/2012 Skalski et al. ..... 99/280
8,250,880 B2 * 8/2012 Moon ..... 62/389
2002/0048621 A1 4/2002 Boyd et al.
2002/0129712 A1 9/2002 Westbrook et al.
2007/0141215 A1 6/2007 Bunke et al.
2009/0136632 A1 5/2009 Gutwein et al.
2010/0116842 A1 * 5/2010 Hecht et al. ..... 222/1
2010/0301066 A1 * 12/2010 Minard et al. ..... 222/1
2010/0308078 A1 * 12/2010 Saveliev et al. ..... 222/129.1

* cited by examiner

*Primary Examiner* — Paul R Durand
*Assistant Examiner* — Donnell Long
(74) *Attorney, Agent, or Firm* — Kirk W. Goodwin; McKee, Voorhees & Sease PLC

(57) ABSTRACT

A refrigerator includes a refrigerator cabinet, a door for providing access to within the refrigerator cabinet, and a beverage dispenser. The beverage dispenser may be positioned at the door. The beverage dispenser includes a water source for supplying water, a beverage flavor source containing a flavor medium and having a flavor source opening with and adjustable size, and a user interface. The user interface is connected to the beverage flavor source to control the amount of flavor medium dispensed by the beverage flavor source through the flavor source opening. The amount of flavor medium dispensed will determine the flavor strength of a flavored beverage after the flavor medium has mixed with water or another liquid.

16 Claims, 3 Drawing Sheets

REFRIGERATOR BEVERAGE FLAVOR DISPENSER WITH FLAVOR STRENGTH ADJUSTMENT

FIELD OF THE INVENTION

The invention relates generally to the field of refrigerators. More specifically, but not exclusively, the present invention provides a flavor dispenser mechanism that allows a user to select the strength of his or her flavored beverage dispensed from a refrigerator beverage dispenser.

BACKGROUND OF THE INVENTION

Many people enjoy drinking flavored beverages. The beverages are generally produced by mixing some kind of flavor medium with water. However, not everyone has been able to agree on the strengths of the flavors of these flavored beverages. People may like them stronger, tasting much like the flavor included. Some may like a little bit of flavor, while tending to prefer a more watered down beverage. Many others may choose some sort of in between strength of flavor. While generally the flavor strength does depend on personal choice, it may also depend on the flavor medium mixed with water.

Obtaining a desired flavor strength in a beverage is often a trial and error process. People will generally add water and flavor medium together in a container. If the flavor is too strong, more water will be added. If the flavor of the beverage it too weak, more flavor medium will be added. The trial and error method is time consuming, and may be costly. People may end up throwing away a beverage that they are not satisfied with, and instead starting over, thus wasting both water and flavor medium. Additionally, even if the user knows exactly how much water and flavor medium they need to mix together to produce a desired flavor strength, the amount of time it takes to measure each component may make doing so inconvenient.

Because people have struggled in figuring out the best way to produce a beverage with a desired flavor strength, they instead choose to purchase their drinks elsewhere. While this solution may be easy, it tends to be costly. The cost people choose to pay for others to make their drink for one day might be enough to pay for the same person to make their drink at home for many days and possibly weeks.

Accordingly, there is a need in the art for an improved beverage dispenser in a refrigerator that is able to produce flavored beverages having varying strengths, with a user being able to select their desired strength. There is also a need in the art for the same beverage dispenser to produce the same strength flavor of beverages every time.

BRIEF SUMMARY OF THE INVENTION

It is therefore a principal object, feature, or advantage of the present invention to provide an improved beverage dispenser of a refrigerator having varying settings for flavor strength of a flavored beverage.

It is another object, feature, or advantage of the present invention to provide an improved refrigerator beverage dispenser having adjustable strength settings for flavored beverages.

It is another object, feature, or advantage of the present invention to provide an improved beverage dispenser for providing a flavored beverage that will produce the same flavor strength according to the same setting every time.

It is another object, feature, or advantage of the present invention to provide an improved beverage dispenser for dispensing a flavored beverage having an easily adjusted user interface for changing the strength of the flavor of the flavored beverage.

These and/or other objects, features, and advantages of the present invention will be apparent to those skilled in the art. The present invention is not to be limited to or by these objects, features and advantages. No single embodiment need provide each and every object, feature, or advantage.

According to one aspect of the present invention, a refrigerator is provided. The refrigerator includes a refrigerator cabinet, a door for providing access to within the refrigerator cabinet, and a beverage dispenser positioned at the door. The beverage dispenser includes a water source for supplying water, a beverage flavor source containing a flavor medium and having a flavor source opening with an adjustable size, and a user interface for selectively controlling volume of flavor medium dispensed from the beverage flavor source for mixing with water to produce a flavored beverage.

According to another aspect of the present invention, a method of dispensing a flavored beverage having a certain flavor strength from a refrigerator beverage dispenser of a refrigerator is provided. The method includes providing a refrigerator having a refrigerator cabinet, at least one door providing access to within the refrigerator cabinet, and a beverage dispenser positioned at the door, the beverage dispenser including a water source, a beverage flavor source containing a flavor medium, a flavor source opening, and a user interface for selectively controlling the volume of flavor medium passing from the beverage flavor source and through the flavor source opening. A user input is received from the user interface. A size of the flavor source opening is adjusted, at least partially based on the user input. Water is dispensed from the water source, and flavor medium is dispensed from the beverage flavor source through the flavor source opening.

According to another aspect of the present invention, a refrigerator beverage dispenser is provided. The beverage dispenser includes a water source, a beverage flavor source containing a flavor medium and having a flavor source opening and a user interface. The user interface is associated with the beverage flavor source such that it is configured to selectively control volume of the flavor medium dispensed from the beverage flavor source for mixing with the water to produce a flavored beverage.

According to yet another aspect of the present invention, a method of dispensing a flavored beverage with different flavor strengths from a refrigerator beverage dispenser is provided. The method includes providing a refrigerator beverage dispenser including a water source, a beverage flavor source containing a flavor medium and having a flavor source opening, and a user interface configured to control the flavor source opening. Input data is received from the user interface, the input data defining a desired flavor strength. The size of the flavor source opening is adjusted based at least partially on the input data. Water is dispensed from the water source and a volume of flavor medium is dispensed through the flavor source opening. The water and the volume of the flavor medium are mixed together to produce a flavor beverage having the desired flavor strength.

DETAILED DESCRIPTION OF THE PREFERRED EMBODIMENTS

Although the present invention is described with respect to various embodiments, the present invention is not to be limited to the specific embodiments described herein. It is further to be understood that no single embodiment of the present invention need have all of these structures to perform all the functions associated with any particular aspect or embodiment of the invention.

Figure 1:
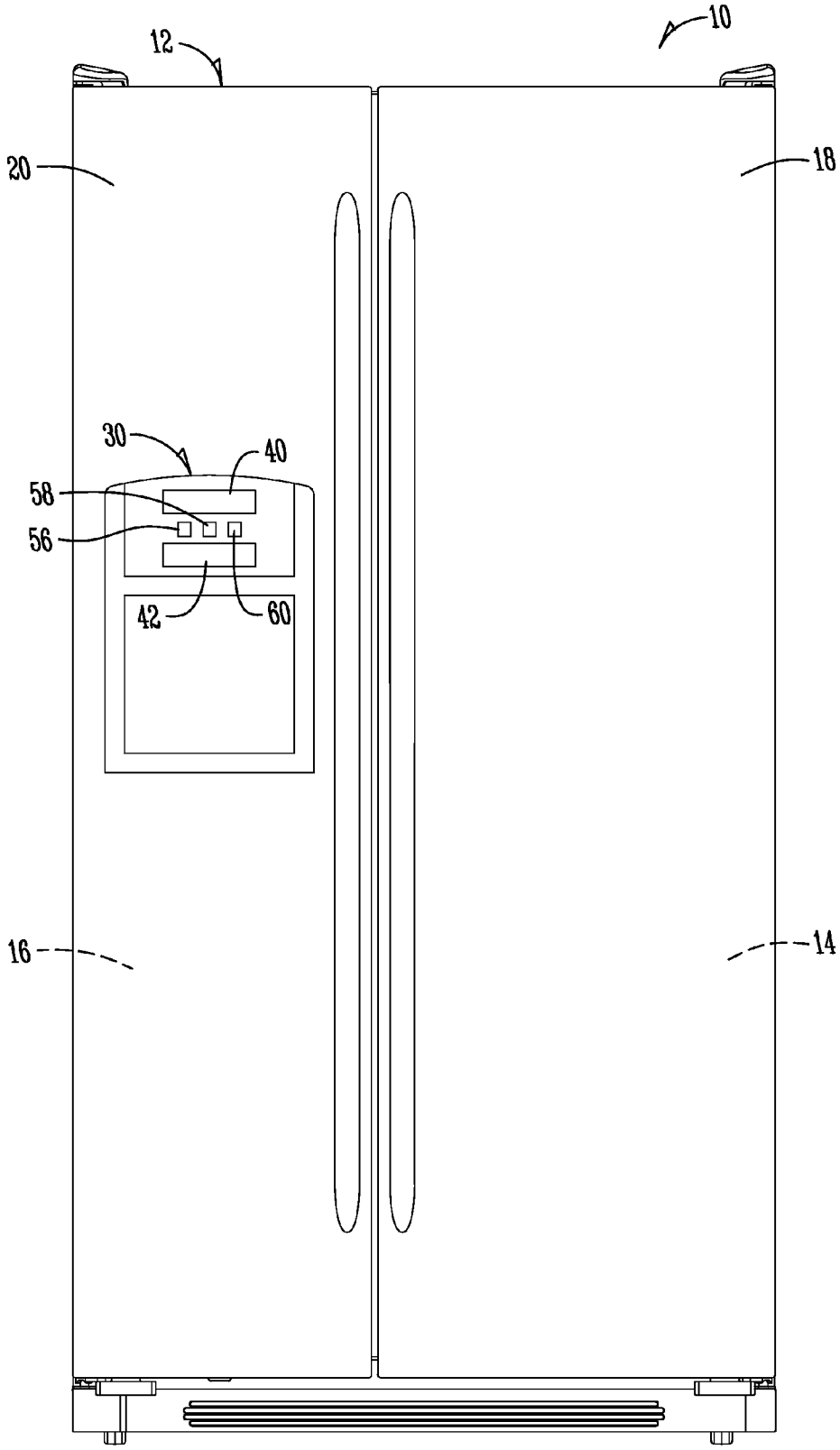
FIG. 1 is a perspective view showing one embodiment of a refrigerator having a beverage dispensing system.

FIG. 1 is a perspective view showing one embodiment of a refrigerator 10 having a beverage dispenser 30. The refrigerator 10 includes a cabinet 12, which is preferably insulated. The refrigerator 10 also includes a fresh food compartment 14 and a freezer compartment 16. Both the fresh food compartment 14 and the freezer compartment 16 are disposed within the refrigerator cabinet 12. There is a fresh food door 18, which provides access to the fresh food compartment 14, and a freezer door 20 that provides access to the freezer compartment 16. Also shown in FIG. 1 is a beverage dispenser 30 positioned at the freezer door 20. While the embodiment shown in FIG. 1 discloses the beverage dispenser 30 positioned at the freezer door 20, it may be positioned elsewhere, such as at the fresh food compartment door 18, within the fresh food compartment 14, or within the freezer compartment 16. It should be appreciated that FIG. 1 does not limit the location of the beverage dispenser 30.

As stated above, the beverage dispenser 30 in FIG. 1 is positioned at the freezer door 20. The beverage dispenser 30 comprises a user interface 40. The user interface 40 allows a user to make choices with respect to the beverage dispenser 30. As shown in FIG. 1, the user interface 40 may comprise a lever 42. The lever 42 may be positioned to select a beverage strength for a flavored beverage 78 dispensed from the beverage dispenser 30. In another embodiment, the user interface 40 comprises a first button 56, a second button 58, and a third button 60, which are used to selectively controlling the volume of a flavor medium 36 that is dispensed and mixed with water 28 to create a flavored beverage 78 of a desired flavor strength.

Figure 2:
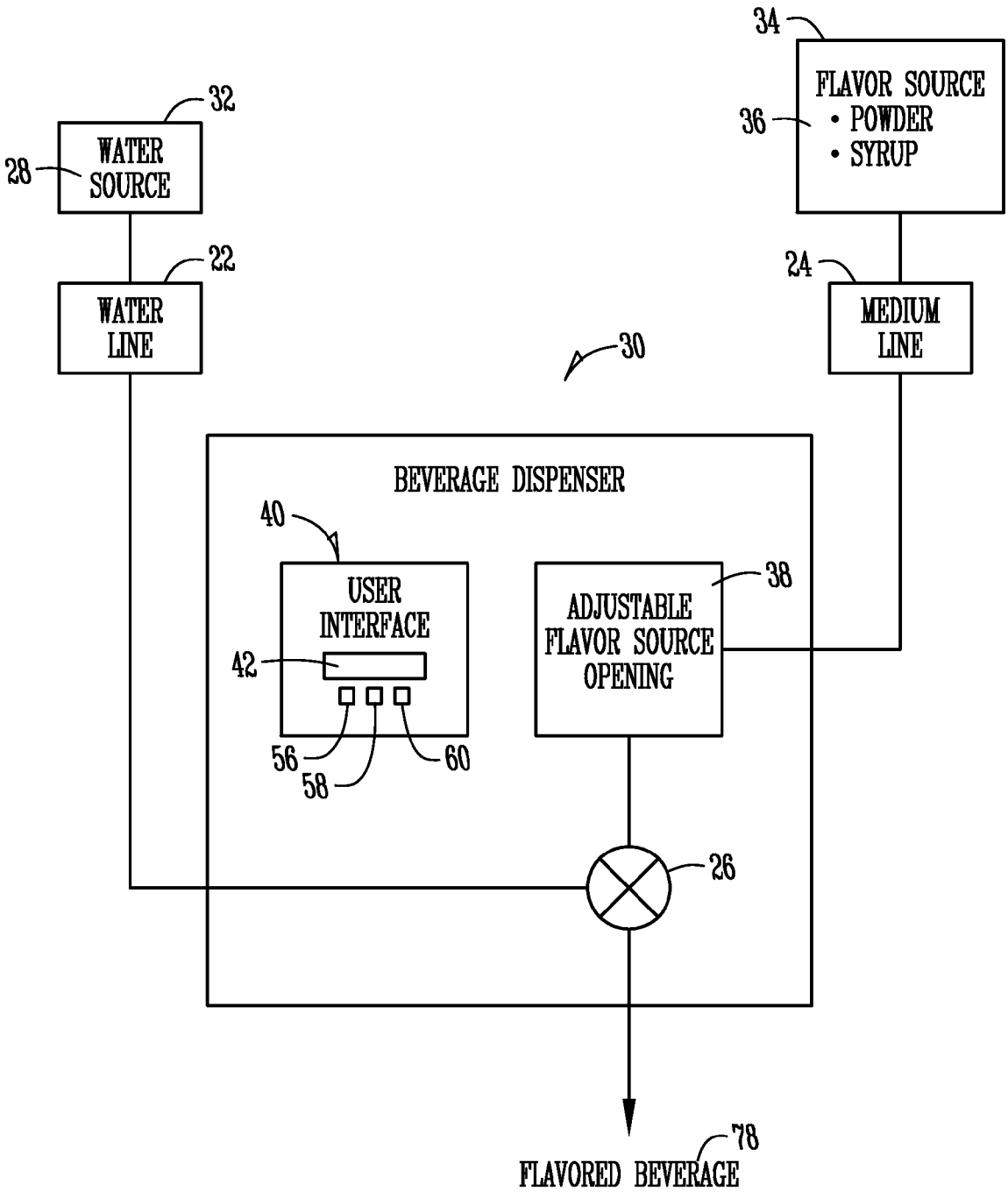
FIG. 2 is a schematic view of a design layout of one embodiment of the present invention.

FIG. 2 is a schematic view of a design layout of one embodiment of the beverage dispenser 30 of the present invention. As shown in FIG. 2, the beverage dispenser 30 includes a water source 32, containing water 28, which is connected to a water line 22. The beverage dispenser 30 also includes a beverage flavor source 34, containing a flavor medium 36, which is connected to a medium line 24. The medium line 24 may include an adjustable flavor source opening 38 for dispensing the flavor medium 36. In the embodiment shown in FIG. 2, the flavor medium 36 comprises either a powder or a syrup. However, other flavor media may be used which, when mixed with water or another liquid, produce a flavored beverage. The invention is not limited to using only powders and syrups. The beverage dispenser 30 further includes a user interface 40, which allows a user to selectively adjust the volume of flavor medium 36 that is dispensed which adjusts the strength of a flavored beverage 78.

The user interface 40 may comprise a lever 42 for selectively adjusting the volume of a flavor medium 36, and thus, the strength of the flavored beverage 78. The lever 42 may include a first position 44, which may be associated with the flavor source opening 38 being fully opened. The lever 42 may include a second position 46 associated with the flavor source opening 38 being less open than with the lever 42 in the first position 44. The lever 42 may also include a third position 48, which may be associated with the flavor source opening 38 having an opening that is sized less than when the lever 42 is in either the first position 44 or the second position 46. In this configuration, the first position 44 coincides with the greatest volume of flavor medium passing through the flavor source opening 38 to produce the strongest flavored beverage 78, while the second position 46 produces a medium strength flavored beverage 78, and the third position 48 allows the least amount of volume of flavor medium 36 to pass through the flavor source opening 38 to produce the weakest strength of flavored beverage 78.

The user interface 40 may also comprise a first button 56, a second button 58, and a third button 60. The first button 56 may be associated with a first size of a flavor source opening which may allow the greatest amount of flavor medium 36 to pass through the flavor source opening 38, the second button 58 is associated with a second size of the flavor source opening 38, and the third button 60 is associated with a third size of the flavor source opening 38, which allows the least amount of volume of flavor medium 36 to pass through the flavor source opening 38. The amount of flavor medium 36 allowed to pass through the flavor source opening 38 is associated with the strength of the flavored beverage 78. The more volume of flavor medium 36 that passes through the flavor source opening 38, the stronger the resulting flavored beverage 78.

The user interface 40 is connected to the adjustable flavor source opening 38, which is also connected to the medium line 24. The water line 22 dispenses water at a mixing location 26. The flavor source opening 38 dispenses flavor medium 36 at the same mixing location 26. A flavored beverage 78 is dispensed from the mixing location 26.

Figure 3:
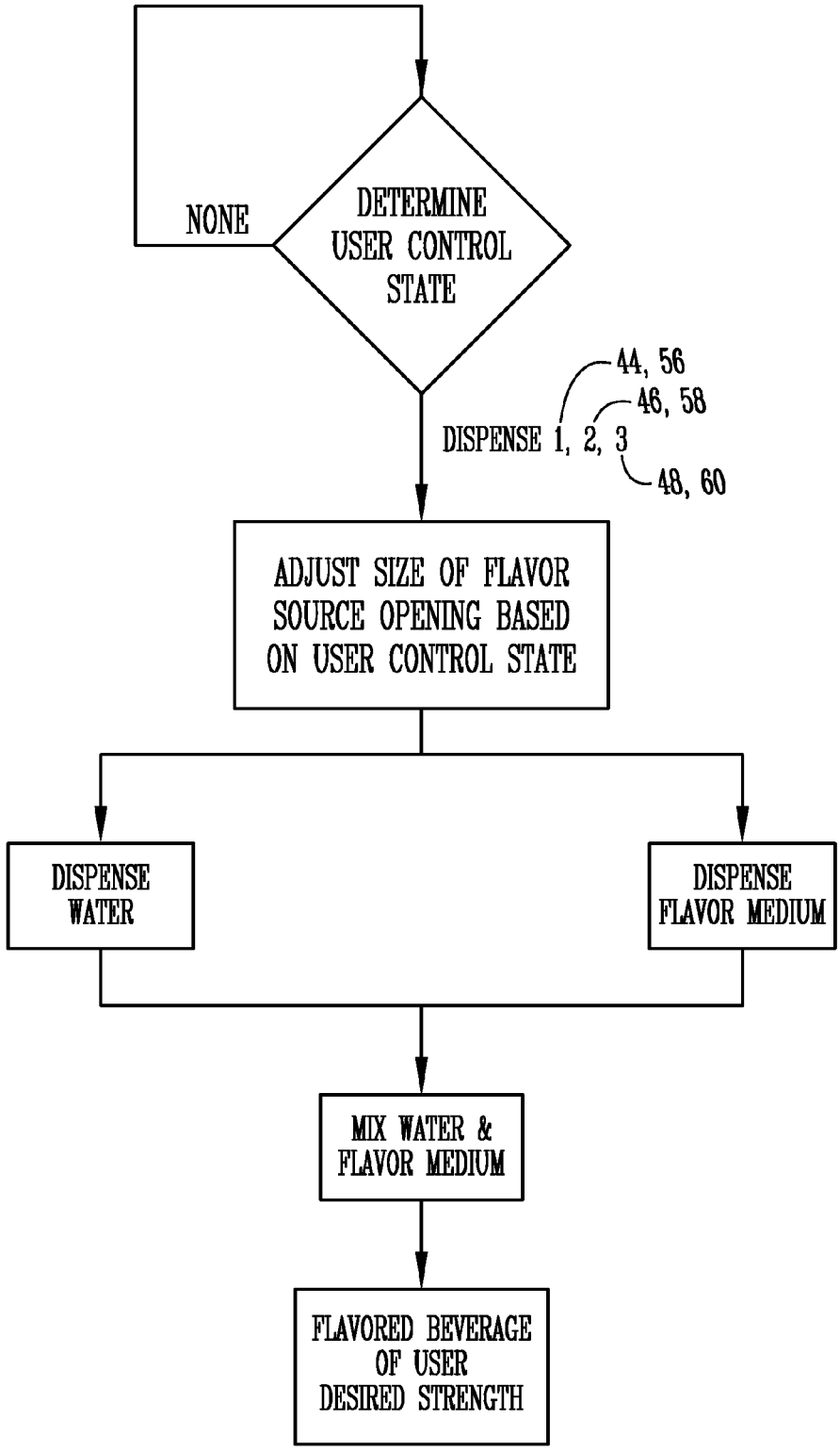
FIG. 3 is a flow diagram showing the steps of a one method of the present invention.

FIG. 3 is a flow diagram showing the steps of a one method of the present invention. A user determines a strength of beverage he or she would like to be dispensed from a refrigerator beverage dispenser. Once the user has made a selection, via a user interface of the beverage dispenser, the beverage dispenser determines the user control state. The user control state could be 0, 1, 2, or 3. If the user control state is deemed to be 0, nothing occurs. The remaining states, 1, 2, and 3, may be associated with either a position of the lever 42, or a button, as discussed above. Once the control state is determined, the size of a flavor source opening 38 is adjusted according to the user control state. A flavor medium 36 is dispensed from a beverage flavor source 34 and water 74 is dispensed from a water source 32. The volume of the flavor medium 36 that is dispensed is determined by the size of the flavor source opening 38. The volume of the flavor medium 36 also determines the strength of a finished flavored beverage 78. The dispensed water 74 and the dispensed flavor medium 36 are then mixed together to produce a flavored beverage 78. The mixing may occur either inside or external the beverage dispenser 30. The dispensed flavored beverage 78 of desired strength may be dispensed into a container of the user's choice.

Although specific embodiments are described herein, the present invention contemplates numerous variations, options, and alternatives, including variations in the structure or a configuration of the refrigerator, or beverage dispensing system. The present invention is not to be limited to the specific embodiments described herein or combinations of the specific embodiments described.

What is claimed is:

1. A refrigerator, comprising:

a refrigerator cabinet;

a door for providing access to within the refrigerator cabinet;

a beverage dispenser positioned at the door, the beverage dispenser comprising a water source for supplying water, a beverage flavor source containing a flavor medium and having a flavor source opening with an adjustable size, and a user interface for selectively controlling volume of flavor medium dispensed from the beverage flavor source for mixing with the water from the water source; and a lever is operably connected to the beverage dispenser to move between a first position, a second position, and a third position, wherein each of the first position, second position, and third position defines a different size for the flavor source opening.

2. The refrigerator of claim 1 wherein the flavor medium comprises a powder.

3. The refrigerator of claim 1 wherein the flavor medium comprises a syrup.

4. The refrigerator of claim 1 wherein the user interface further includes a first button, a second button, and a third button.

5. The refrigerator of claim 4 wherein the first button is associated with a first size of a flavor source opening, the second button is associated with a second size of the flavor source opening, and the third button is associated with a third size of the flavor source opening.

6. A method of dispensing a flavored beverage having a certain flavor strength from a refrigerator beverage dispenser of a refrigerator, comprising:

providing a refrigerator, the refrigerator comprising a refrigerator cabinet, at least one door providing access to within the refrigerator cabinet, and a beverage dispenser positioned at the door, the beverage dispenser including a water source, a beverage flavor source containing a flavor medium, a flavor source opening, and a user interface for selectively controlling a volume of flavor medium passing from the beverage flavor source and through the flavor source opening;

receiving user input from the user interface;

adjusting a size of the flavor source opening at least partially based on the user input to provide an adjusted volume of the flavor medium;

dispensing water from the water source;

dispensing the adjusted volume of the flavor medium from the beverage flavor source from the flavor source opening;

communicating the adjusted volume of the flavor medium through a line to a mixing point in communication with water from the water source; and controlling beverage strength at the mixing point by adjusting the size of the flavor source opening.

7. The method of claim 6 wherein the size of the flavor source opening determines a volumetric amount of the flavor medium allowed to pass from the beverage flavor source and through the flavor source opening.

8. The method of claim 7 further comprising mixing the water and the flavor medium to produce a flavored beverage.

9. The method of claim 8 wherein the flavored beverage is mixed outside of the beverage dispenser.

10. A refrigerator beverage dispenser, comprising:

a water source for supplying water;

a beverage flavor source containing a flavor medium and having a flavor source opening;

a user interface associated with the beverage flavor source, wherein the user interface selectively controls volume of the flavor medium dispensed from the beverage flavor source for mixing with the water to produce a flavored beverage; and a first pushbutton, a second pushbutton, and a third pushbutton at the user interface, the first pushbutton is associated with a first flavor source opening size, the second pushbutton is associated with a second flavor source opening size, and the third pushbutton is associated with a third flavor source opening size.

11. The refrigerator beverage dispenser of claim 10 wherein the user interface comprises a lever.

12. The refrigerator beverage dispenser of claim 11 wherein the lever having a first position associated with the first flavor source opening size, a second position associated with the second flavor source opening size, and a third position associated with the third flavor source opening size.

13. The refrigerator beverage dispenser of claim 10 wherein the first flavor source opening size is associated with a first flavor strength, the second flavor source opening is associated with a second flavor strength, and the third flavor source opening size is associated with a third flavor strength.

14. A method of dispensing a flavored beverage with different flavor strengths from a refrigerator beverage dispenser, comprising:

providing a refrigerator beverage dispenser including a water source, a beverage flavor source containing a flavor medium and having a flavor source opening, and a user interface configured to control the flavor source opening;

receiving input data from the user interface, the input data defining a desired flavor strength;

adjusting the size of the flavor source opening at least partially based on the input data;

dispensing water from the water source;

dispensing a volume of flavor medium through the flavor source opening;

carrying the dispensed volume of flavor medium through a line having an inlet adapted for communication with the flavor source opening and an outlet adapted for communication with a mixing point; and mixing the water and the volume of flavor medium together to produce a flavored beverage having the desired flavor strength as based upon adjustments to the flavor source opening.

15. The method of claim 14 wherein the mixing of the water and flavor medium occurs outside of the beverage dispenser.

16. The method of claim 14 wherein the user interface comprises at least one of a button or a lever.

* * * * *